US008919979B2

(12) United States Patent
Mabry et al.

(10) Patent No.: US 8,919,979 B2
(45) Date of Patent: Dec. 30, 2014

(54) ELECTRONIC APPARATUS FOR HOSE ATTACHMENT TO ENHANCE VISIBILITY, COMMUNICATION, ATMOSPHERIC MONITORING, EARLY DETECTION AND WARNING FOR FIRE FIGHTER SCENE SAFETY AND METHOD THEREFOR

(71) Applicants: James Mabry, Anthem, AZ (US); Danny Kleitsch, Scottsdale, AZ (US)

(72) Inventors: James Mabry, Anthem, AZ (US); Danny Kleitsch, Scottsdale, AZ (US)

(73) Assignee: All Clear Fire Systems, LLC, Phoenix, AZ (US)

( * ) Notice: Subject to any disclaimer, the term of this patent is extended or adjusted under 35 U.S.C. 154(b) by 141 days.

(21) Appl. No.: 13/665,618

(22) Filed: Oct. 31, 2012

(65) Prior Publication Data

US 2014/0118998 A1 May 1, 2014

(51) Int. Cl.

| | |
|---|---|
| ***F21V 33/00*** | (2006.01) |
| ***F21L 4/02*** | (2006.01) |
| ***F21V 21/00*** | (2006.01) |
| ***A62C 31/02*** | (2006.01) |

(52) U.S. Cl.

CPC . *F21L 4/02* (2013.01); *F21V 21/00* (2013.01); *A62C 31/02* (2013.01); *F21V 33/0064* (2013.01); *Y10S 239/00* (2013.01)

USPC ..... 362/96

(58) Field of Classification Search

CPC ..... A62C 31/02; B24C 5/02; B25F 5/021; F24F 13/078

USPC ..... 362/96

See application file for complete search history.

(56) References Cited

U.S. PATENT DOCUMENTS

| | | | | |
|---|---|---|---|---|
| 3,706,882 | A * | 12/1972 | Eby | 362/398 |
| 3,943,312 | A * | 3/1976 | Bernstein et al. | 200/61.58 R |
| 5,795,053 | A | 8/1998 | Pierce | |
| 5,873,647 | A * | 2/1999 | Kurtz et al. | 362/96 |
| 6,116,520 | A | 9/2000 | Lee | |
| 7,739,921 | B1 | 6/2010 | Babcock | |
| 7,823,801 | B2 * | 11/2010 | McGarry et al. | 239/18 |
| 7,942,544 | B2 * | 5/2011 | Smathers | 362/157 |
| 7,969,414 | B2 * | 6/2011 | Wang et al. | 345/156 |
| 7,992,648 | B2 | 8/2011 | Groonwald | |
| 8,109,645 | B2 | 2/2012 | Liao | |
| 2006/0131038 | A1 | 6/2006 | Lichtig | |
| 2006/0180321 | A1 * | 8/2006 | Yoshida | 169/13 |
| 2009/0050835 | A1 | 2/2009 | Boise | |
| 2011/0187524 | A1 | 8/2011 | Cochran, III | |
| 2012/0061108 | A1 | 3/2012 | Cerrano | |
| 2012/0120630 | A1 * | 5/2012 | Liao et al. | 362/96 |

OTHER PUBLICATIONS

All Clear Fire Lights—Archived Website Publication—Captured Jan. 29, 2011—http://web.archive.org/web/20110129143936/http://www.allclearfirelights.com/.*

* cited by examiner

*Primary Examiner* — Robert May
*Assistant Examiner* — Alexander Garlen
(74) *Attorney, Agent, or Firm* — Venjuris, P.C.

(57) ABSTRACT

An illumination device for attachment to a hose has a housing coupled to the hose. The housing allows a substance from the hose to flow through the housing. An electronic circuit is stored in an interior of the housing to illuminate an area in front of the hose.

17 Claims, 13 Drawing Sheets

ELECTRONIC APPARATUS FOR HOSE ATTACHMENT TO ENHANCE VISIBILITY, COMMUNICATION, ATMOSPHERIC MONITORING, EARLY DETECTION AND WARNING FOR FIRE FIGHTER SCENE SAFETY AND METHOD THEREFOR

BACKGROUND

This invention generally relates to firefighting equipment and more particularly pertains to a new illuminated fire hose attachment for providing a portable, optional light source for a fire hose that illuminates a target or a pathway as well as provide sensors for indicating/monitoring current conditions and warning systems to alert fire fighters of hazardous conditions and assist in the location of lost or incapacitated fire fighters.

Today's fire fighters are asked to fill many roles and operate on diverse emergency scenes. These scenes include structural fire fighting, wild land fire fighting, vehicular accidents, technical rescues, hazardous material exposures, and emergency medical incidents. All of these incident scenes present unique and different challenges. One of the commonalities is the utilization by fire fighters of hand lines with various extinguishing agents on almost every scene. Fire fighters use these hand lines not only to extinguish fire, but to protect themselves and the citizens they are called to serve, at any scene day or night. Fire fighters are required to carry an inordinate number of hand tools to include personal flashlights, scene lighting, extrication tools, fire fighting tools, medical equipment, and radios. The complexity of the work environment and minimum staffing on most emergency scenes makes it virtually impossible for crews to be adequately prepared and carry all the tools they need for any one situation. The necessity to return to on scene fire vehicles to retrieve additional equipment is time consuming and dangerous. Fire fighters need a new option to lessen their work loads, enhance visibility, improve communication, identify unseen hazards, provide early warning, and make the operating environment a more efficient and safer place to work.

Therefore, it would be desirable to provide a device and method that overcomes the above problems. The device and method would provide a hands-free tool to assist fire crews involved in search, rescue, and fire suppression efforts. The device and method would provide a lighting source to be used in fire fighting operations that provides adequate lighting for safe operations inside or outside a structure. An example of inside operations would be a commercial structure fire, apartment fire, or house fire. An example of outside operations would be a wild land fire or illuminating the scene of a vehicle accident. The device and method would provide a high-intensity light source that may be affixed to any nozzle on a hand line of a fire hose.

The device and method would provide for atmospheric monitoring to detect hazardous materials in the work environment. The device and method would provide for personal health monitoring of individual fire fighters to promote early treatment for sickness or injury. The device and method would act as an early warning device for structure collapse, self-contained breathing apparatus air management, or lost/incapacitated fire fighter. The device and method would provide these benefits and enhanced communication through a hands-free, voice free lighting system easily visible to the fire fighters on the face of the device. Command units on the perimeter of the emergency scene would be constantly apprised of fire fighting operating conditions and could communicate instantly the necessity to change strategy, withdraw crews from dangerous situations, or affect a rescue.

SUMMARY

An illumination device for attachment to a hose has a housing coupled to the hose. The housing allows a substance from the hose to flow through the housing. An electronic circuit is stored in an interior of the housing to illuminate an area in front of the hose.

An illumination device for attachment to a hose has a housing attached to the hose, wherein the housing allows a substance from the hose to flow through the housing. An electronic circuit is stored in an interior of the housing to illuminate an area in front of the hose. The electronic circuit has a power supply removably attached to an exterior of the housing; and a plurality of lighting units coupled to the power supply.

An illumination device for attachment to a hose has a housing. A pipe is positioned through the housing to allow a substance from the hose to flow through the housing. An electronic circuit is stored in an interior of the housing, wherein the electronic circuit comprises: a power supply removably attached to an exterior of the housing; a plurality of lighting units coupled to the power supply to illuminate an area in front of the hose; a timer coupled to the power supply; and an on/off switch coupled to the timer and the power supply, the on/off switch activating and deactivating the electronic circuit, wherein the on/off switch illuminates for a predetermined amount of time based on the timer.

The features, functions, and advantages may be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
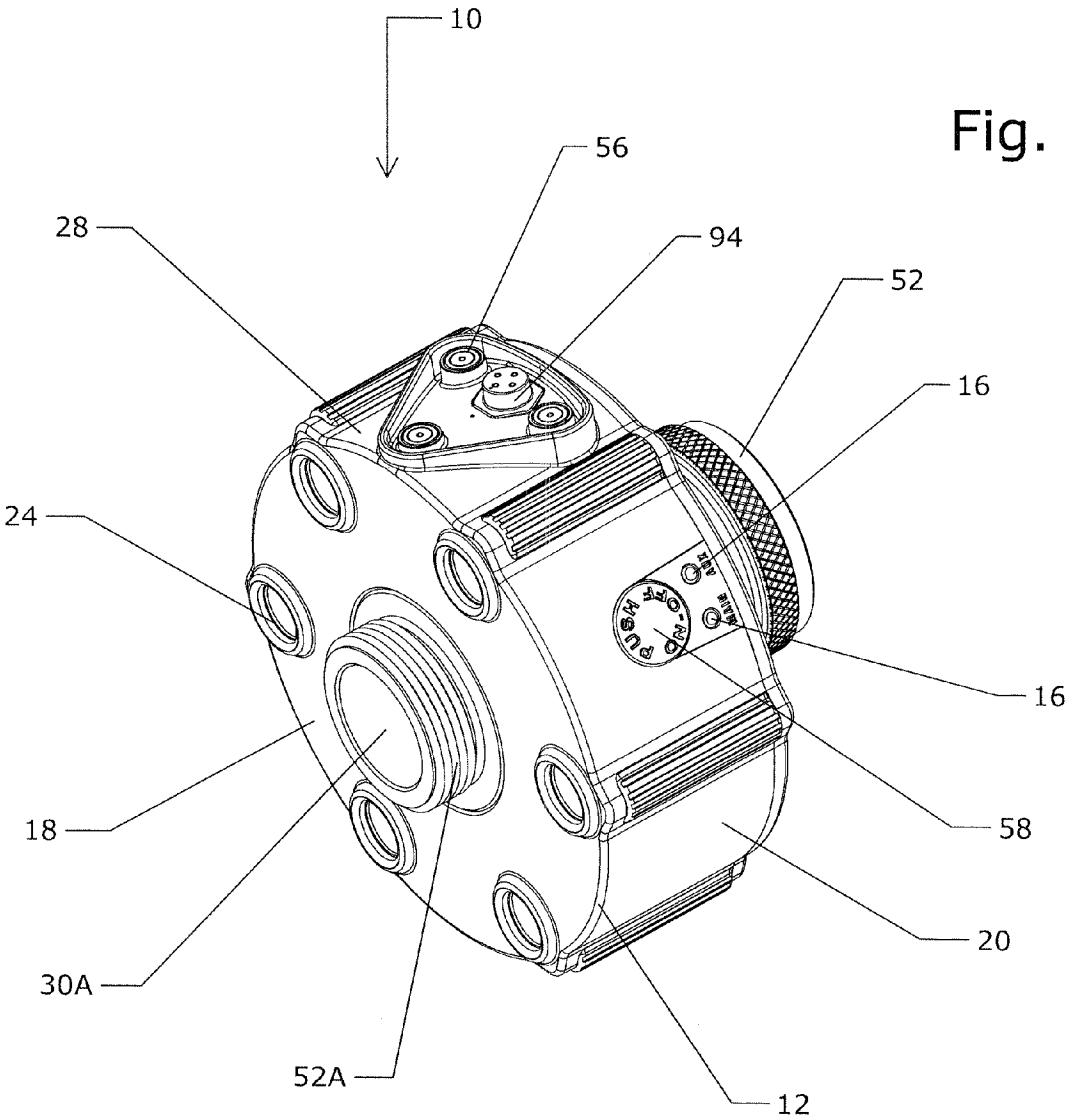
FIG. 1 is a first elevated perspective view of the light source device of the present invention.
Figure 2:
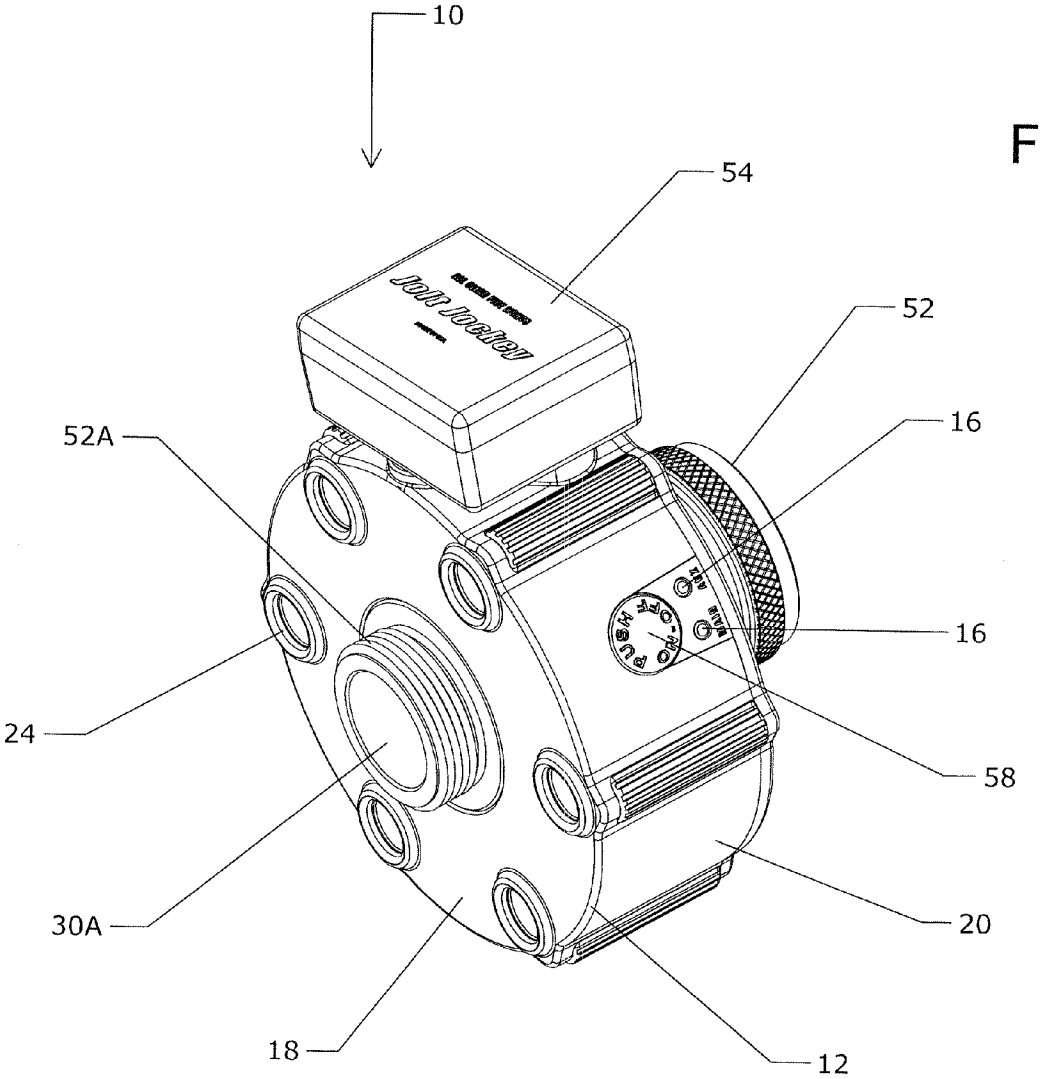
FIG. 2 is the first elevated perspective view of the light source device in accordance with FIG. 1 with a battery pack attached thereto.
Figure 3:
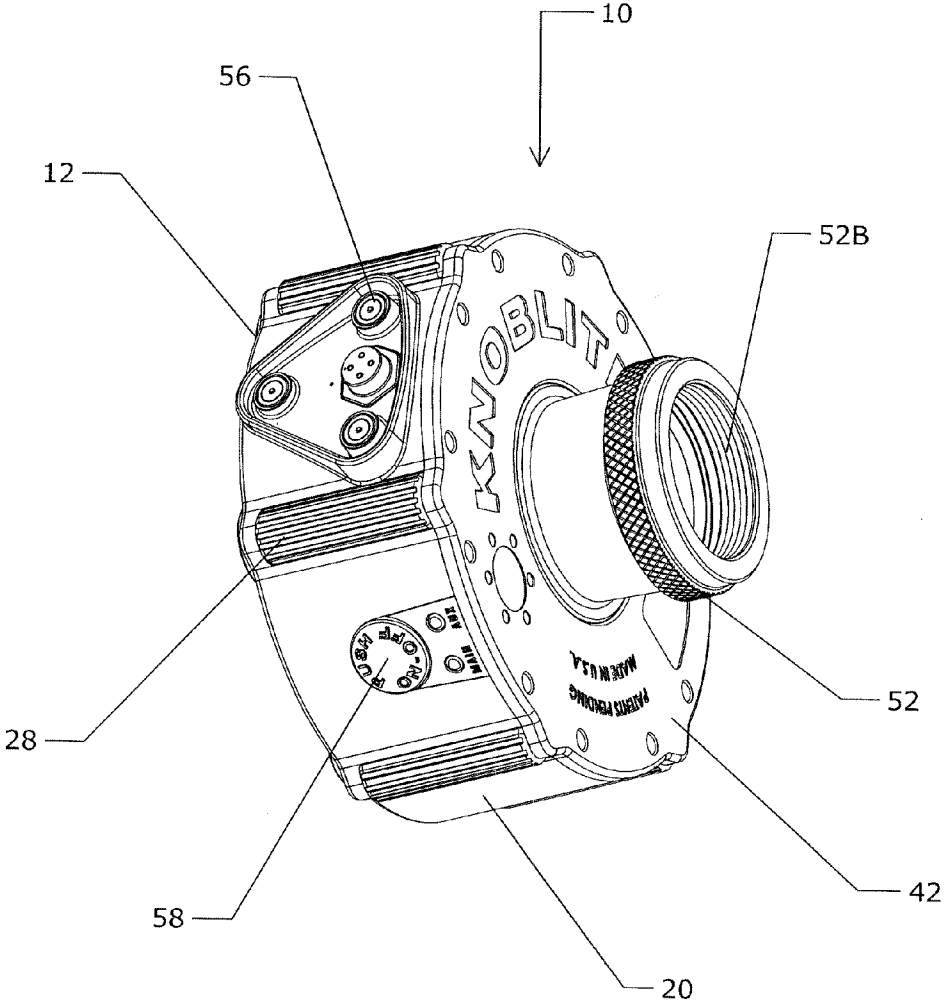
FIG. 3 is a second elevated perspective view of the light source device of the present invention.
Figure 4:
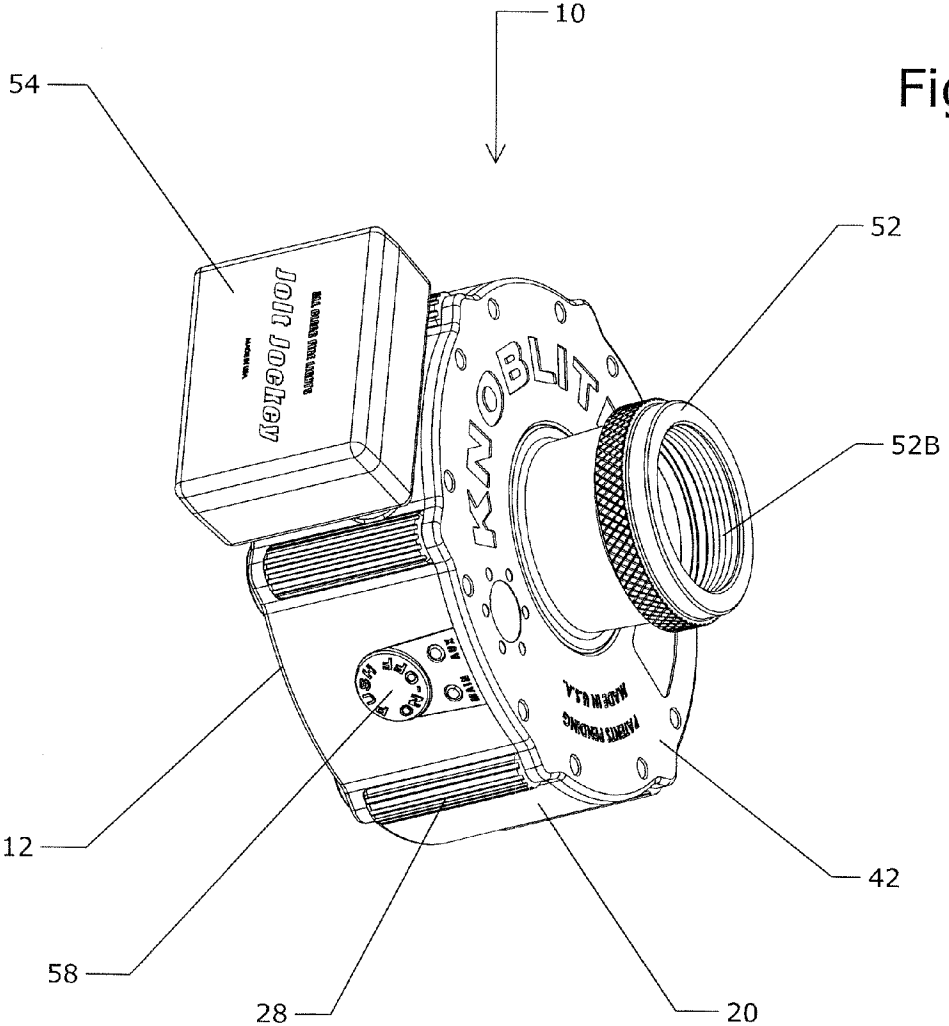
FIG. 4 is the second elevated perspective view of the light source device in accordance with FIG. 2 with the battery pack attached thereto.

Referring to the Figures, a light source device (hereinafter device 10) of the present invention is shown. The device 10 may be attached to any fire hose/nozzle as will be described below. The device 10 may provide future generations of fire fighters with a means that attaches to fire nozzles and fire hose couplings that may allow fire fighters to advance hose lines into structure fires, wild land fires, vehicle fires, hazardous material environments, and other hazardous situations without the necessity of these fire fighters assuming the burden of carrying hand held flashlights on their person. The device 10 may further provide visual indicators about current operating conditions for the firefighters as will be discussed below.

The device 10 may be configured to securely fit between a fire nozzle 60 and fire hose coupling 62. Alternatively, the device 10 may be positioned between two fire hose couplings 62. The device 10 is designed to not impede the flow of extinguishing agent or to be obstructive when moved around the fire ground when the device 10 is positioned between the fire nozzle 60 and fire hose coupling 62 or between two fire hose couplings 62.

The device 10 may have a housing 12. The housing 12 may be used to store and house a plurality of lighting fixtures 14. The preferred lighting fixtures 14 each comprise a light source unit 32 and a columnar shape; the columnar shape positioned between the light source unit 32 and a lens 34. The lighting fixtures 14 may be used to illuminate the fire ground and guide the fire fighter as he/she advances the hose lines. The housing 12 may further be used to store and house one or more visual indicators 16. The visual indicators 16 may be used to provide warnings to the firefighters about current operating conditions. The housing 12 may be constructed of a material that is lightweight, durable, heat resistant, cold resistant, water resistant, and able to function flawlessly in the demanding environments occupied by fire fighters in the course of their work.

The housing 12 may be formed of different geometric shapes. In the present embodiment, the housing 12 is circular in shape. A circular shape housing 12 may provide the least amount of resistance when moving the fire house with the device attached. However, the circular shape is shown as one embodiment, and should not be seen in a limiting manner.

The housing 12 may be comprised of a front plate 18. An exterior side wall 20 may be formed around an outside perimeter of the front plate 18. An interior side wall 21 may be formed around an inside perimeter of the front plate 18. The exterior side wall 20 may be formed to extend up from the front plate 18 there by forming a hollow interior section 22 of the housing 12. The interior section 22 may be used to store and house the plurality of lighting fixtures 14 as well as electronics for one or more visual indicators 16.

One or more light openings 24 may be formed through the front plate 18. The light openings 24 may be formed around the perimeter of the front plate 18. The light openings 24 may be used to position the one or more lighting fixtures 14 within the housing 12. One or more light slots 26 may also be formed within the side wall 20. The one or more light slots 26 may be formed next to and adjacent a corresponding light opening 24. The light slots 26 may be used to allow easy removal of a corresponding lighting fixture 14. A lighting fixture plate 28 may be positioned within each light slot 26 to secure the lighting fixture 14 within the light slot 26 and corresponding light opening 24. The lighting fixture plate 28 may be designed to be pressure fitted within the light slots 26. Thus, by applying pressure to the lighting fixture plate 28, one may be able to release the lighting fixture plate 28 from within the light slots 26, thereby allowing one to remove the corresponding lighting fixture 14.

As stated above, a plurality of lighting fixtures 14 are positioned within the housing 12. As shown in the Figures, each lighting fixture 14 may be comprised of a light source unit 32. Each light source unit 32 may be a high-intensity, LED lighting fixture that may be able to illuminate the fire ground and guide the fire fighter as he/she advances hose lines. A lens 34 may be positioned in front of each light source unit 32. The lens 34 may be used to focus and/or direct the light from the light source unit 32. The lens 34 may also be used to protect the light source unit 32. A lens housing 36 may be used to secure the lens 34 in front of each light source unit 32. A plate member 38 may be used to secure the lighting fixture 14 within the interior section 22 of the housing 12.

Figure 5:
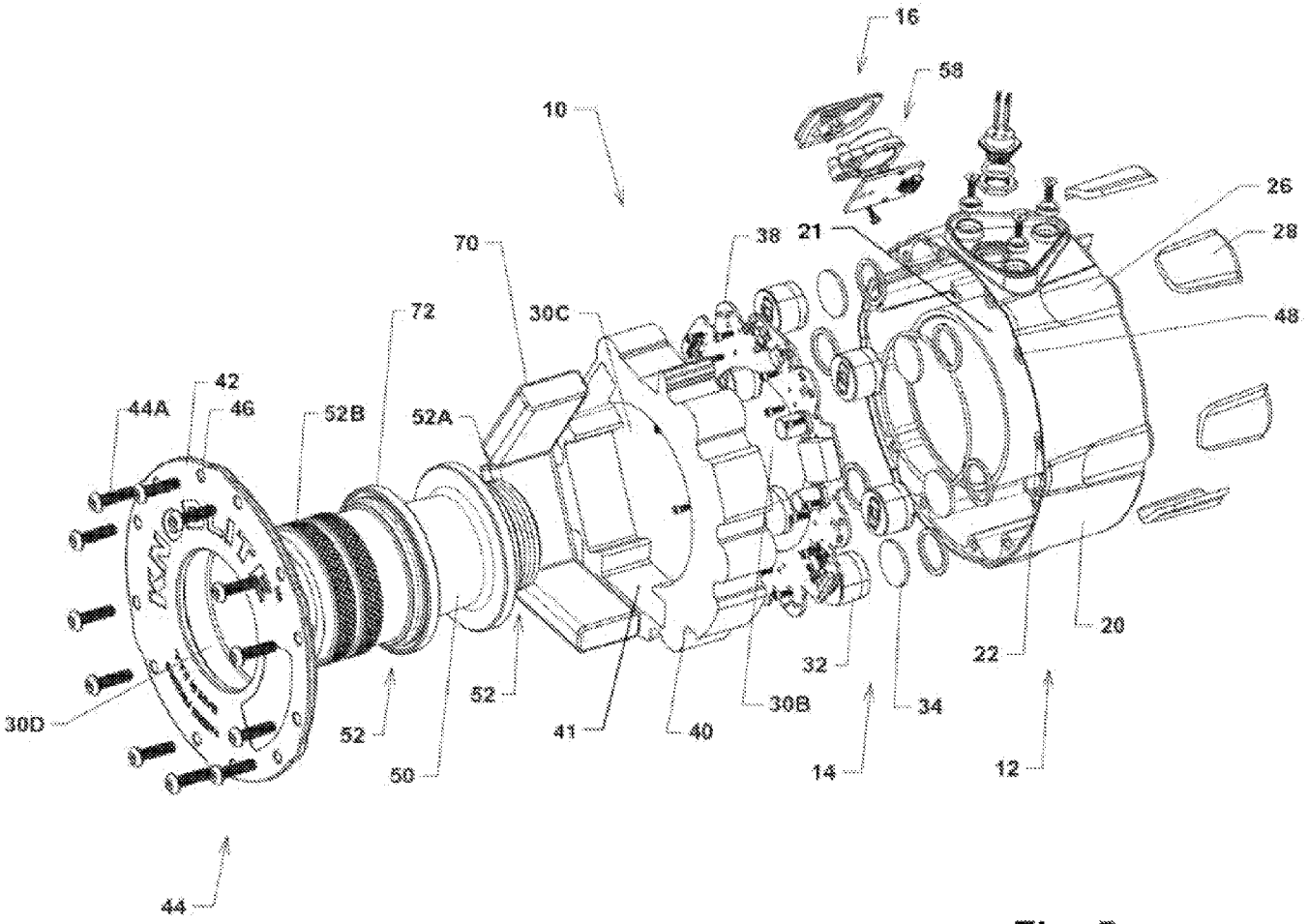
FIG. 5 is a first exploded side view of the light source device of the present invention.
Figure 6:
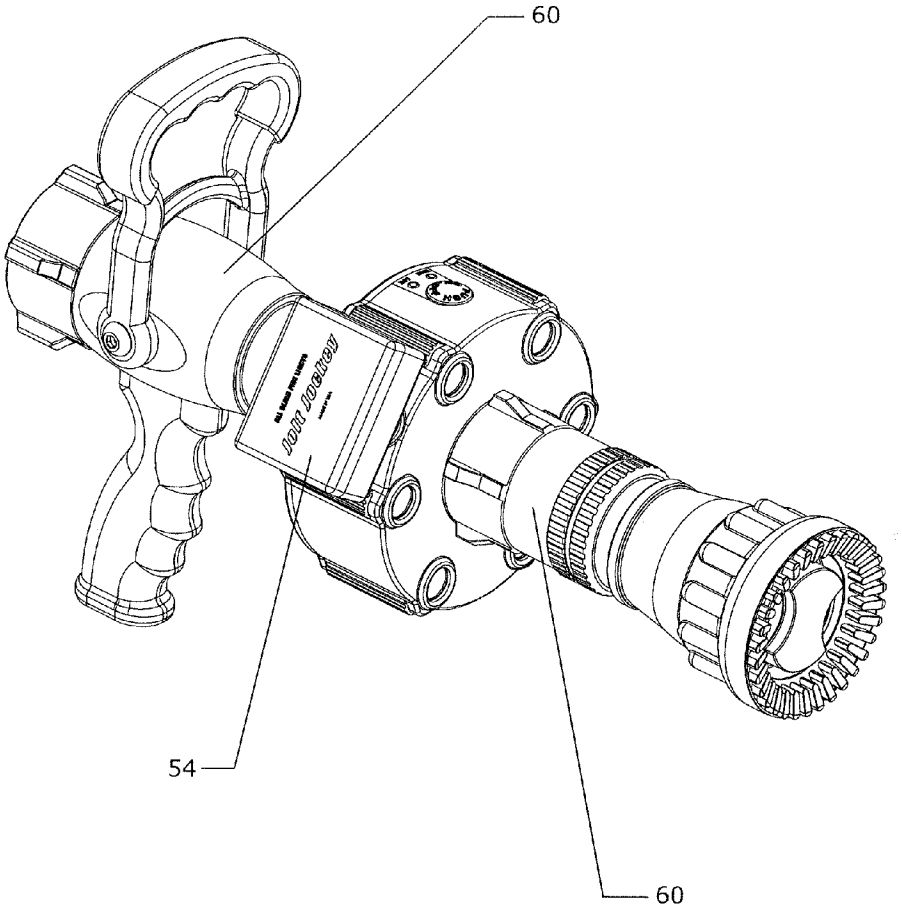
FIG. 6 is a first elevated perspective view of the light source device with a battery pack attached to a fire hose.
Figure 7:
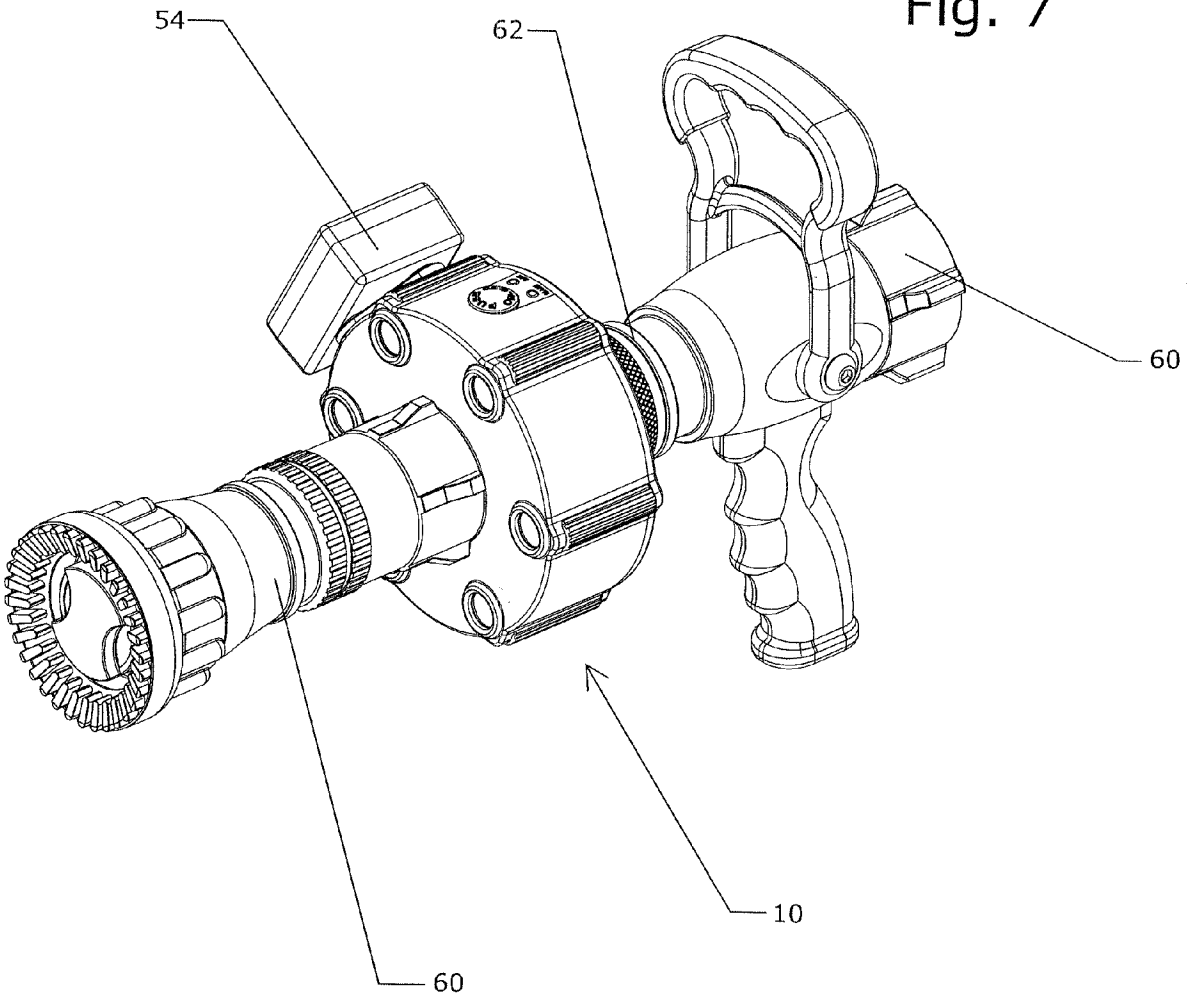
FIG. 7 is a second elevated perspective view of the light source device with a battery pack attached to a fire hose.
Figure 8:
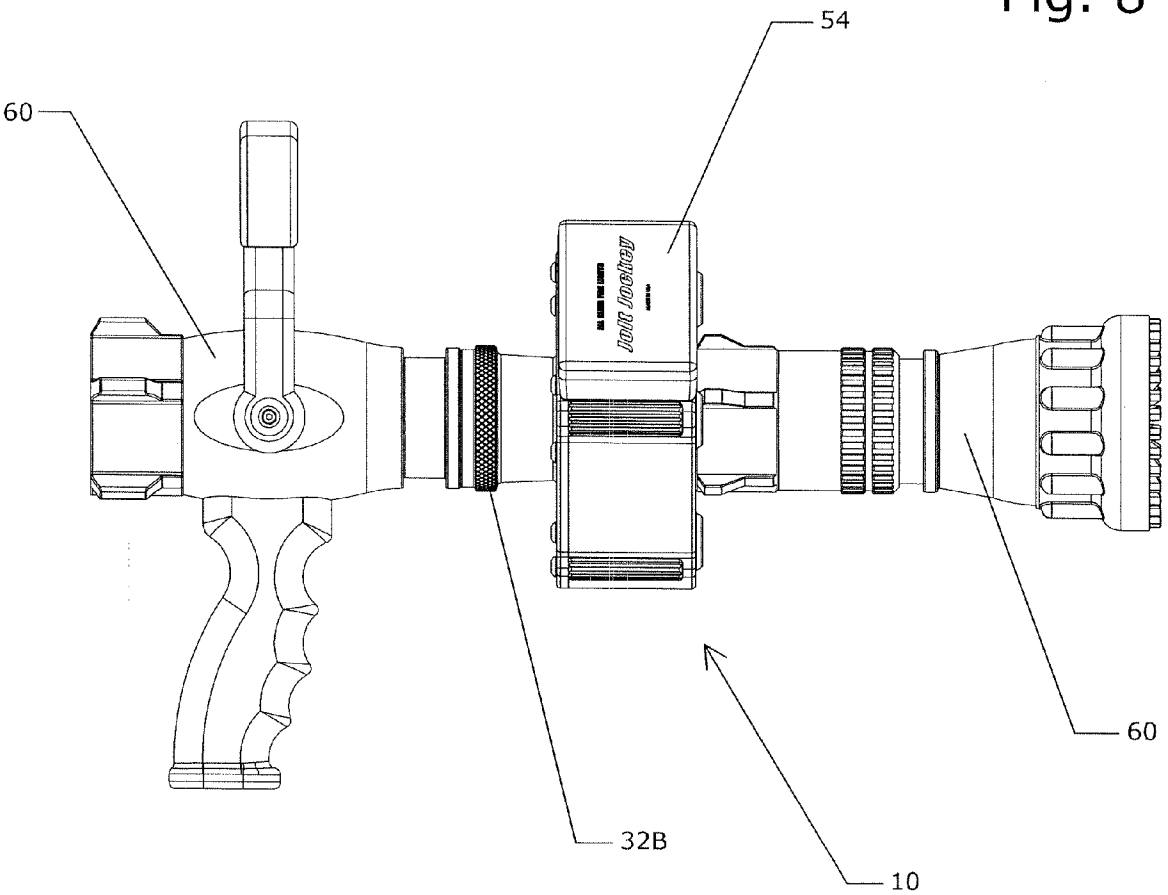
FIG. 8 is a side view of the light source device with a battery pack attached to a fire hose.
Figure 9:
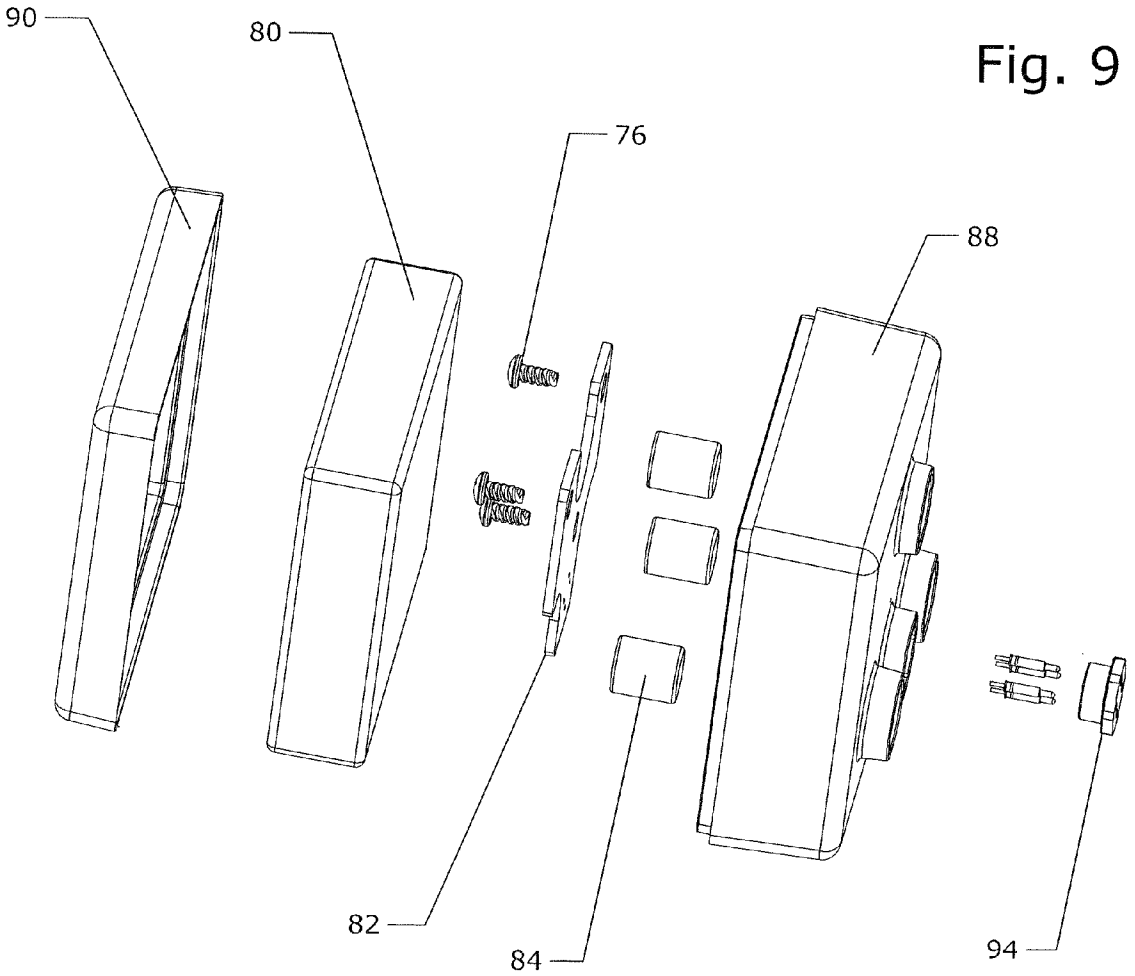
FIG. 9 is an exploded perspective view of the battery pack used with the light source device of the present invention.
Figure 10:
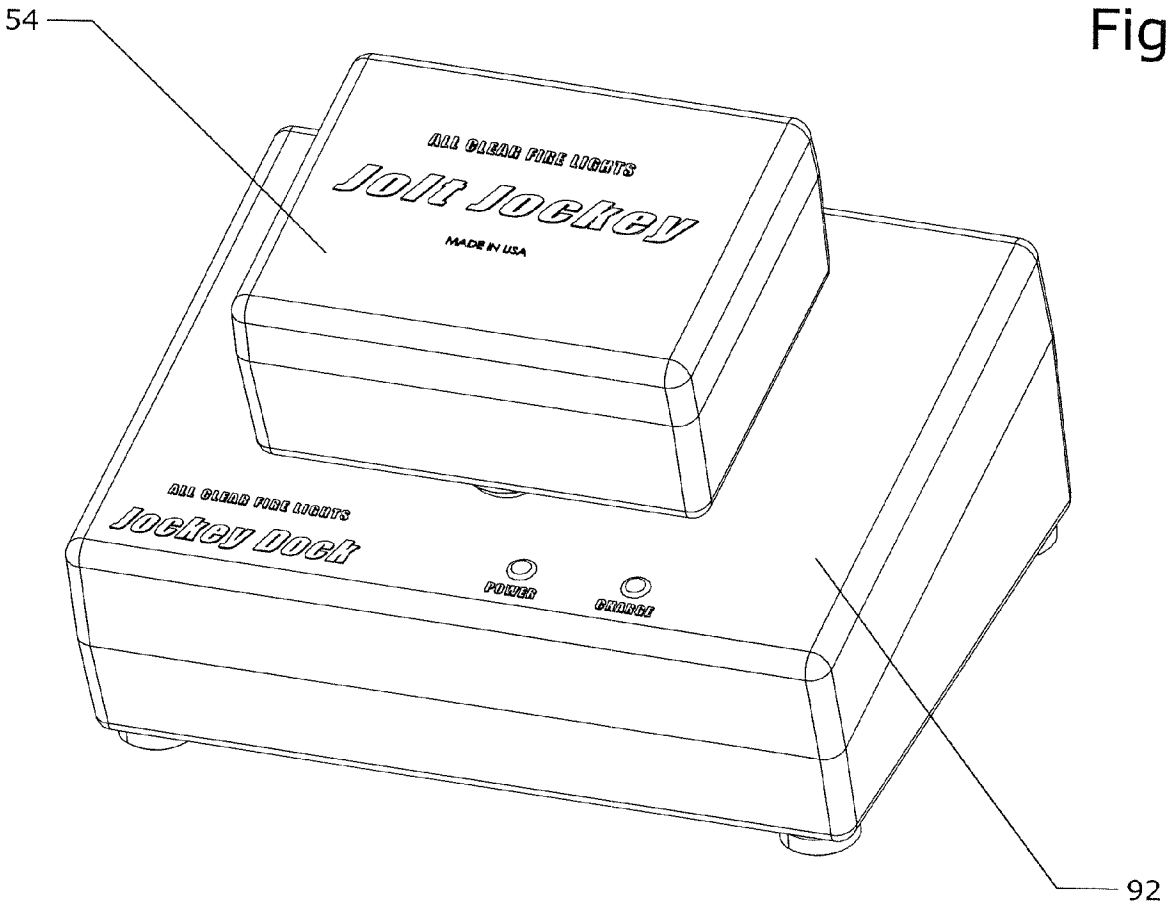
FIG. 10 is an elevated perspective view of the battery pack used with the light source device of the present invention attached to a charger.
Figure 11:
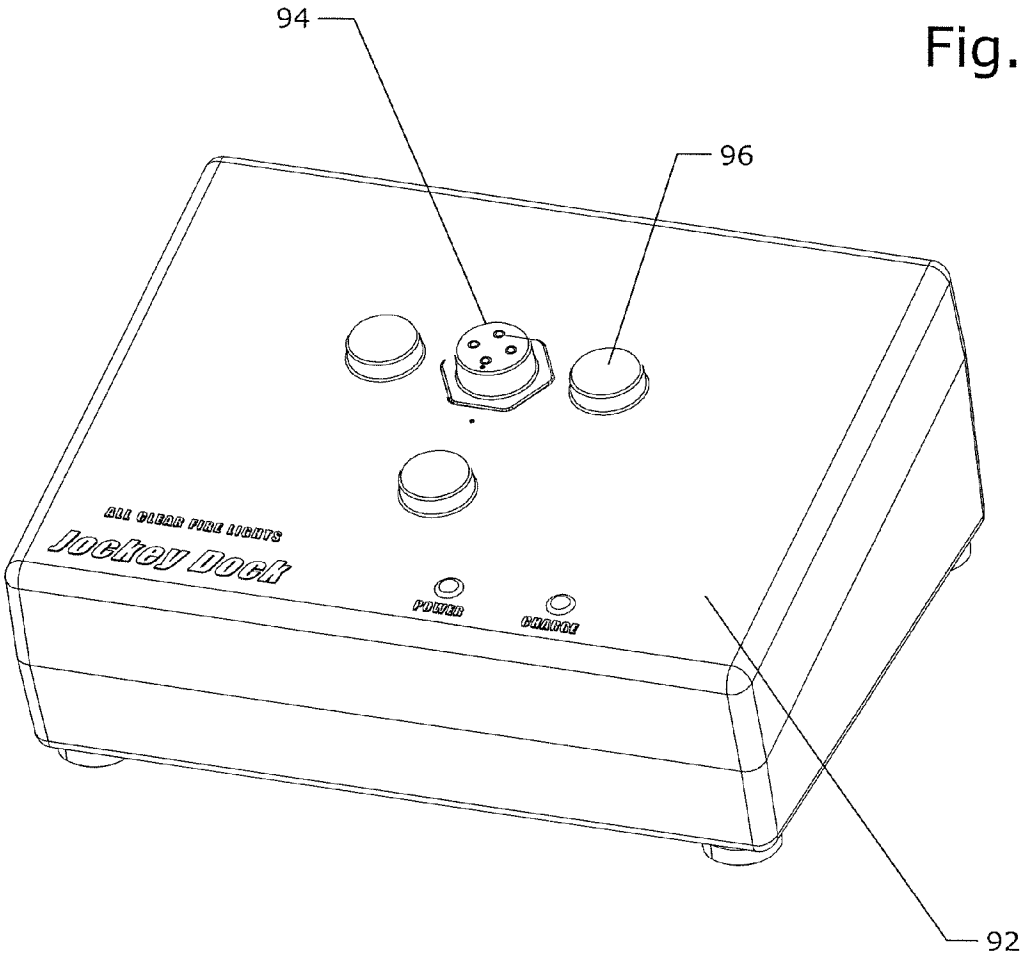
FIG. 11 is an elevated perspective view of the charger used with the battery pack.
Figure 12:
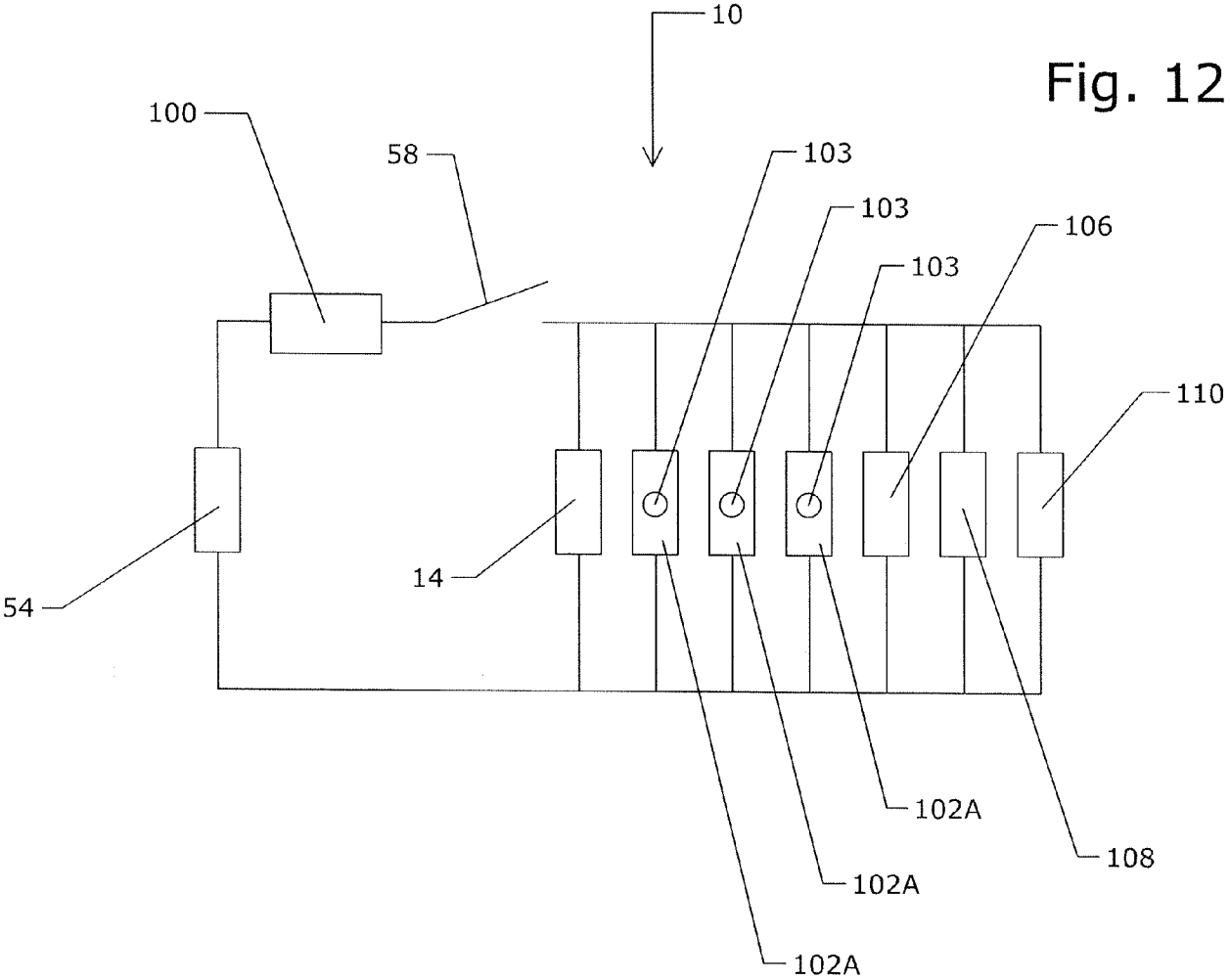
FIG. 12 is a block diagram of the electronic circuit used in the present invention.
Figure 13:
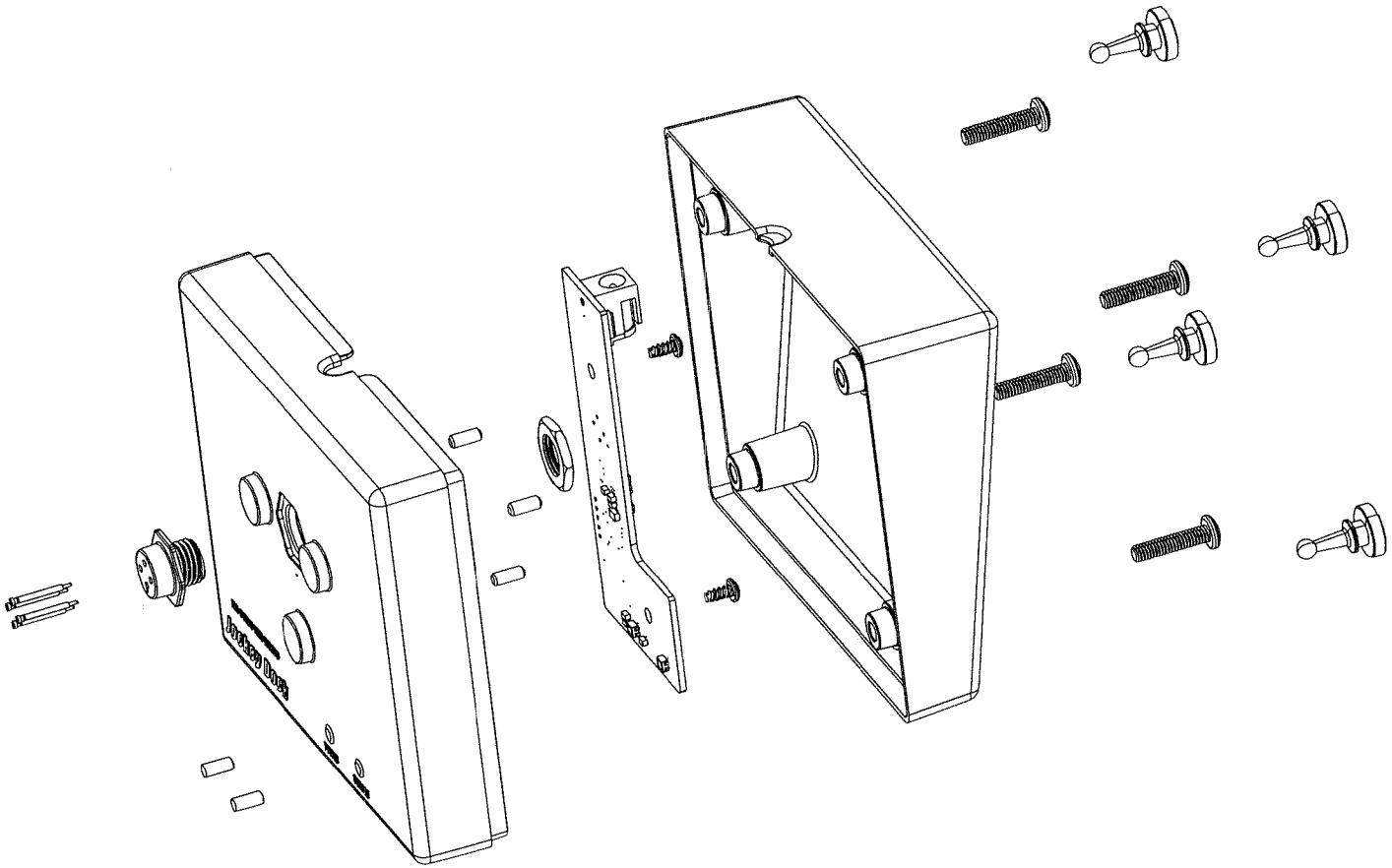

The housing 12 may have a toroid-shaped cover 40. The cover 40 may be positioned over the interior section 22 of the housing 12. Thus, the cover 40 may be used to enclose the interior section 22. A locking plate 42 may be used to secure the cover 40 to the housing 12. The locking plate 42 may have one or more securing members 44. The securing members 44 may be used to secure the cover 40 to the housing 12. Grooves or slots located on the interior perimeter of the cover 40 are configured to slidably engage electronic circuitry 70. More specifically, the cover 40 has a slot surface 41 that complements or matches the exterior shape of the electronic circuitry 70 so that the electronic circuitry 70 can slidably engage with the slot surface 41. Placing electronic circuitry 70 in the slots radially isolates the electronic circuitry 70 from the housing 12 and the exterior of housing 12. See FIG. 5, which illustrates an exploded view of a preferred embodiment. The cover 40 also having an outside perimeter edge or shape that complements or matches the hollow interior side wall of the housing 12. In accordance with one embodiment, the securing members 44 may be a plurality of screws 44A. As shown in the Figures, one or more openings 46 may be formed around an outer perimeter of the locking plate 42. Each opening 46 may be aligned with a corresponding channel 48 formed on the housing 12. Each channel 48 may be formed on the side wall 20. Each channel 48 may be threaded so as to engage a corresponding screw 44A.

The front plate 18, the plate member 38, the cover 40, and locking plate 42 may each have a central opening 30A, 30B, 30C and 30D respectively, formed there through. The central openings 30A, 30B, 30C and 30D may be used to allow the extinguishing agent to enter and flow through the housing 12.

A pipe 50 may be positioned through the housing 12. The pipe 50 may be used to allow the extinguishing agent to pass through the housing 12. In accordance with the embodiment depicted in the Figures, the pipe 50 may be positioned through the central openings 30A, 30B, 30C and 30D formed through the front plate 18, the plate member 38, the cover 40, and locking plate 42 respectively. The pipe 50 may be used to allow the extinguishing agent to enter and flow through the housing 12.

The pipe 50 is designed to not impede the flow of extinguishing agent or to be obstructive when moved around the fire ground when the device 10 is positioned between the fire nozzle 60 and fire hose coupling 62 or between two fire hose couplings 62. The pipe 50 may have a coupling 52 located on each end. The coupling 52 may be used to connect the pipe 50 between the fire nozzle 60 and fire hose coupling 62 or between two fire hose couplings 62. The coupling 52 may be a threaded end 52A, a threaded hose coupling 52B, or the like. The above is given as an example and should not be seen in a limiting manner. Other couplings may be used without departing from the spirit and scope of the present invention.

The pipe 50 may further have a pair of ring members 72. A ring member 72 may be positioned on each end of the pipe 50. The ring members 72 may be used to secure the pipe 50 within the housing 12.

The housing 12 may have one or more contacts 56. The contacts 56 may be used to secure a power supply 54 to the housing 12. The power supply 54 may be used to power electronic circuitry 70 stored within the housing 12. The power supply 54 is interchangeable so that a current power supply 54 may be removed, and a fully charged power supply attached to the contacts 56. The power supply 54 may also be a rechargeable power supply.

The Figures show one embodiment of the power supply 54. As may be seen in the Figures, the power supply 54 may have a battery unit 80. The battery unit 80 may be used to supply a DC power source to the electronic circuitry 70. The battery unit 80 may have a contact board 82 attached thereto. One or more securing devices 76 may be used to secure the contact board 82 to the battery unit 80. The contact board 82 may be used to attach a battery contact 84 to the battery unit 80. The battery contact 84 may be used to attach the power supply 54 to contacts 56. This may allow the power supply 54 to attach to the electronic circuitry 70. When in use, the battery contact 84 may contact the contacts 56 to secure the power supply 54 to the housing 12 and to the electronic circuitry 70.

The battery unit 80 may be stored within a battery housing 88. A lid 90 may be attached to the battery housing 88 thereby enclosing the battery unit 80 within the battery housing 88.

In accordance with one embodiment, the battery unit 80 is a rechargeable battery unit. One or more charging pins 92 may be coupled to one of the battery contacts 84. This may allow the charging pins to attach to a charging plug 94 of a recharging unit 92. One or more alignment pins 90 may be formed on the battery housing 88. The alignment pins 90 may be used to align the power supply 54 onto a recharging unit 92 having corresponding alignment pins 96.

The housing 12 may store electronic circuitry 70. The electronic circuitry 70 may be positioned within the interior section 22 of the housing 12. The electronic circuitry 70 may be capable of connecting and operating a myriad of simple systems that perform functions essential to fire fighter safety.

A switch 58 may be coupled to the power supply 54. The switch 58 may be used to activate and deactivate the electronic circuitry 70. The switch 58 may be located on the exterior of the housing 12. The switch 58 may be programmed to "turn on" with a 0.5 second engagement and "turned off" with a 3.0 second engagement to avoid any inadvertent termination of the electronic circuitry 70 during operation. The switch 58 may further double as a "CAP" (conditions, air, people) elapsed time warning light. Fire fighters are taught that 10 minutes of flame impingement on building structural components seriously effect construction integrity and pose serious collapse hazards to fire fighters inside structure. The switch 58 may be an illuminating switch. When activated, the switch 58 may automatically initiate a timer 100. The switch 58 may appear "green" advising fire fighters that they have been inside the "hot zone" for less than 10 minutes. At 10 minutes the switch 54 will begin blinking "red". This will remind fire fighters to address their tactical priorities:

(1) Conditions: re-evaluate the interior conditions of the structure for safety.

(2) Air: check the available air in you and your crew's SCBA bottles.

(3) People: know the location and condition of all your assigned members.

and begin to plan their egress from the structure. At 15 minutes the blinking "red" will become a solid "red". This will provide a "fire fighter off line/MAYDAY" safety feature that will keep the device illuminated to act as a beacon for fire fighters attempting to find the hand line in low visibility environments or locate lost/incapacitated fire fighters. The light function on the switch 56 can again be illuminated by engaging the switch 58 for 0.5 second.

One of the functions of the electronic circuitry may be to provide a high-intensity, LED lighting system able to illuminate the fire ground and guide the fire fighter as he/she advances hose lines. Thus, the lighting fixtures 14 are generally coupled to the power supply 54. The lighting fixtures 14 may be programmed to automatically turn off at 15 minutes to save on the life of the power supply 54 should the nozzle be unattended and acts as a timer for work cycles. Whether inside a structure, outside on a wild land fire, or on the scene of an auto accident the lighting fixtures 14 may have a minimum of two settings, high/low. The choice of light intensity will not affect the light timing as it is independent of the fire fighter choice of light intensity. Timing requirements can be altered or customized per individual fire department specifications and needs.

One or more sensors/alarms 102 may also be coupled to the power supply 54. One of the sensors/alarms 102 may be for example a hazmat monitor 102A. The hazmat monitor 102A may monitor for hazardous materials such as $O_2$, CO, $SO_2$, CN, radiation, LEL (explosion limit), and the like. The listing of the above is given as an example and should not be seen in a limiting manner. The hazmat monitor 102A may be coupled to a visual indicator 103 Thus, when hazmat monitor 102A detects a specified hazardous material, the corresponding visual indicator 103 may illuminate.

The electronic circuitry 70 may further have a receiver/transmitter unit 106. The receiver/transmitter unit 106 may be used to transmit data collected from the electronic circuitry 70 to a desired location (i.e., command post, etc.). The receiver/transmitter unit 106 may further be used to receive data transmitted by another party. For example, the receiver/transmitter unit 106 may receive a command to evacuate the building transmitted by the command post. In this situation, the receiver/transmitter unit 106 may cause the electronic circuitry 70 to start flashing all visual indicators 103.

The receiver/transmitter unit 66 may further be able to receive and then transmit current health data of the firefighter. For example, a firefighter may wear one or more sensors to monitor the firefighter's health (i.e, heart rate, blood pressure, $O_2$ levels, etc. The information monitored by these sensors may then be collected and transmitted by the receiver/transmitter unit 106 to a desired location (i.e., command post, etc.).

The electronic circuitry 70 may further have a display screen 108. The display screen 108 may be used to display graphical information. For example, the display screen 108 may display information captured by the sensors 102 and or sensors on the firefighters as discussed above. The display screen 108 may display information transmitted by the command post. The above is given as examples of information that may be displayed on the display screen 108. Other information may be displayed without departing from the spirit and scope of the present invention. It should also be noted that the display screen 108 may be used for other purposes than that described above without departing from the spirit and scope of the present invention.

The electronic circuitry 70 may further have a distress button 110. The distress button 110 when activated would alert others that a firefighter is in need of help. The distress button 110 may send a signal which causes all of the lighting fixtures 14 to start flashing. The distress button 110 may send a signal to the receiver/transmitter unit 106 which may transmit a signal to a command post that the firefighter is in trouble. The above are given as examples. The distress button 110 when activated may alert others that a firefighter is in need of help in other ways without departing from the spirit and scope of the present invention.

While embodiments of the disclosure have been described in terms of various specific embodiments, those skilled in the art will recognize that the embodiments of the disclosure may be practiced with modifications within the spirit and scope of the claims.

What is claimed is:

1. A device for attachment to a hose, comprising:

a hollow housing with a front plate having an inner perimeter and an outer perimeter, an interior side wall at the inner perimeter and an exterior side wall at the outer perimeter, each side wall extending substantially perpendicularly rearward from the front plate, a housing interior formed by the front plate, interior side wall, and exterior side wall;

a plurality of lighting openings formed through the front plate;

a switch connecting a plurality of light fixtures to electronic circuitry inside the hollow housing, each light fixture positioned in one of the plurality of lighting openings to emit light forward from the front plate and substantially parallel to the interior side wall;

a toroid-shaped cover with an exterior perimeter shape configured to fit inside the exterior side wall and an inside perimeter shape configured to slidably engage the electronic circuitry, the cover radially separating the electronic circuitry from the exterior side wall; and a housing back plate attachable to the exterior side wall to seal the housing interior.

2. A device for attachment to a hose in accordance with claim 1, wherein the inside perimeter shape comprises a slot surface configured to complement an exterior shape of the electronic circuitry to allow the electronic circuitry to slidably engage the slot surface.

3. A device for attachment to a hose in accordance with claim 1, wherein:

a power supply connectable to the exterior of the hollow housing via contacts mounted on the exterior of the hollow housing, the power supply configured to power the electronic circuitry inside the hollow housing.

4. A device for attachment to a hose in accordance with claim 1, further comprising a fire hose coupling attachable to and in line with the interior side wall.

5. A device for attachment to a hose in accordance with claim 4, further comprising a fire hose coupling coupled to an end of the interior side wall and in line with the interior side wall to secure one of a hose or a nozzle on the end of the interior side wall and housing.

6. A device for attachment to a hose in accordance with claim 1, further comprising:

a power supply coupled to the exterior side wall electrically coupled to the plurality of light sources.

7. A device for attachment to a hose in accordance with claim 6, wherein the power supply is removably attached by a plurality of magnets triangularly positioned around an electrical contact in the exterior side wall of the housing.

8. A device for attachment to a hose in accordance with claim 1, further comprising:

a timer coupled to the power supply; and an on/off switch coupled to the timer and the power supply, the on/off switch activating and deactivating the electronic circuit, wherein the on/off switch illuminates for a predetermined amount of time based on the timer.

9. A device for attachment to a hose in accordance with claim 8, wherein the electronic circuit further comprises at least one monitor coupled to the power supply, wherein the at least one monitor measures air quality.

10. A device for attachment to a hose in accordance with claim 8, wherein the electronic circuit further comprises a transmitter/receiver coupled to the power supply for transmitting and receiving data to and from the electronic circuit.

11. A device for attachment to a hose in accordance with claim 8, wherein the electronic circuit further comprises a display coupled to the power supply.

12. A device for attachment to a hose comprising:

a housing having a housing interior side wall pipe, an exterior side wall and a hose coupling having a hose coupling interior side wall, the housing interior side wall pipe and the hose coupling interior side wall are aligned and against which a substance may flow through and contact the housing interior side wall pipe and the hose coupling interior side wall of the housing;

a plurality of lighting fixtures coupled against the housing and positioned to illuminate an area in front of the housing;

electronic circuitry received within a slot in an interior perimeter of a toroid-shaped cover, the slot configured to compliment an exterior shape of the electronic circuitry, the cover configured to radially separate the electronic circuitry from the exterior side wall.

13. A device for attachment to a hose in accordance with claim 12, further comprising:

a power supply located outside of the hollow housing, but connectable to an exterior of the housing via contacts mounted on the exterior of the housing, the power supply configured to power the electronic circuitry located within the hollow housing;

a timer coupled to the power supply; and an on/off switch coupled to the timer and the power supply, the on/off switch activating and deactivating the electronic circuit, wherein the on/off switch illuminates for a predetermined amount of time based on the timer.

14. A device for attachment to a hose in accordance with claim 12, further comprising at least one monitor coupled to the power supply, wherein the at least one monitor measures air quality.

15. A device for attachment to a hose in accordance with claim 12, further comprising a transmitter/receiver coupled to the power supply for transmitting and receiving data to and from the electronic circuit.

16. A device for attachment to a hose in accordance with claim 12, wherein the housing further comprises:

a faceplate;

a plurality of lighting openings formed through the faceplate to allow the lighting units to illuminate an area in front of the faceplate;

a side wall formed around a perimeter of the faceplate and extending upward to form a hollow interior of the housing; and a locking plate to secure the cover over the hollow interior.

17. A device for attachment to a hose comprising:

a housing;

a pipe positioned through the housing to allow a substance to flow through the housing; and electronic circuitry stored inside the housing, the electronic circuitry slidably engaged with a slot surface on an interior perimeter of a toroid-shaped cover, the slot surface configured to complement an exterior shape of the electronic circuitry, the cover radially separating the electronic circuitry from an exterior side wall of the housing a power supply removably attached to the exterior side wall of the housing, the power supply configured to supply power to the electronic circuitry;

a plurality of lighting fixtures coupled to the electronic circuitry to illuminate an area in front of the hose;

a timer coupled to the power supply; and an on/off switch coupled to the timer and the power supply, the on/off switch activating and deactivating the electronic circuit, wherein the on/off switch illuminates for a predetermined amount of time based on the timer.

* * * * *